US007152777B2

(12) United States Patent
McClure

(10) Patent No.: US 7,152,777 B2
(45) Date of Patent: Dec. 26, 2006

(54) STACKABLE CASE READY BREAKER CONTAINER AND BLANK

(75) Inventor: Jack A. McClure, Omaha, NE (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/676,301

(22) Filed: Sep. 30, 2003

(65) Prior Publication Data

US 2005/0067477 A1 Mar. 31, 2005

(51) Int. Cl.
*B65D 5/28* (2006.01)

(52) U.S. Cl. ..... 229/143; 229/152; 229/190; 229/918

(58) Field of Classification Search ..... 229/143, 229/152, 154, 190, 191, 918
See application file for complete search history.

(56) References Cited

U.S. PATENT DOCUMENTS 1,207,899 A * 12/1916 Greve ..... 229/191
4,056,223 A * 11/1977 Williams ..... 229/190
4,319,710 A * 3/1982 Osborne ..... 229/143
5,000,377 A * 3/1991 McClure ..... 229/154
5,002,224 A * 3/1991 Muise ..... 229/918
5,285,956 A * 2/1994 Piepho ..... 229/191
5,289,970 A * 3/1994 McClure ..... 229/143
5,370,303 A * 12/1994 Fry ..... 229/143
6,367,690 B1 * 4/2002 McClure ..... 229/143
6,402,020 B1 * 6/2002 McClure ..... 229/143

* cited by examiner

*Primary Examiner*—Gary E. Elkins

(57) ABSTRACT

The present invention is directed to a stackable container and container blank. In accordance with the present invention, a single sheet of foldable material is cut and scored to define container blank. The blank includes a bottom panel and a side panel connected with the bottom panel. An end panel is connected with the bottom panel. A top panel is connected with said side panel opposite the bottom panel. Also, a top panel flap is connected with said top panel. The blank further includes a corner first panel that is connected with the end panel. Also, a corner second panel is connected with the corner first panel opposite the end panel. Further, a corner third panel connected with said corner second panel opposite said corner first panel, said corner third panel defining a corner third panel cutout.

7 Claims, 6 Drawing Sheets

STACKABLE CASE READY BREAKER CONTAINER AND BLANK

FIELD OF THE INVENTION

This invention relates generally to containers and container blanks and, more specifically to convertible cap and tray type containers for bulk products.

BACKGROUND OF THE INVENTION

High strength containers are known in the art. Specifically, containers designed for higher crushing strength use multi-wall corrugated material or else fasten several layers of corrugated material together to form a container with relatively thick container walls. Typically, the side walls and end walls of a container reinforced in this manner are fully covered by the extra supporting material. However, this type of design is not cost effective because more material is used than is required to form a container with the desired strength properties.

SUMMARY OF THE INVENTION

The present invention is directed to a stackable container and container blank. In accordance with the present invention, a single sheet of foldable material is cut and scored to define container blank. The blank includes a bottom panel and a side panel connected with the bottom panel. An end panel is connected with the bottom panel. A top panel is connected with said side panel opposite the bottom panel. Also, a top panel flap is connected with said top panel. The blank further includes a corner first panel that is connected with the end panel. Also, a corner second panel is connected with the corner first panel opposite the end panel. Further, a corner third panel connected with said corner second panel opposite said corner first panel, said corner third panel defining a corner third panel cutout.

The present invention further includes a single sheet of foldable material cut and scored to define a container. The container includes a bottom panel and a side panel connected with the bottom panel. Also, an end panel is connected with the bottom panel. A top panel is connected with the side panel opposite the bottom panel. A top panel flap is connected with said top panel. The container also includes a corner first panel connected with the end panel and adjacent to the side panel. A corner second panel is connected with the corner first panel such that the corner second panel is adjacent the corner first panel opposite said side panel. Also, a corner third panel is connected with the corner second panel and the corner third panel is adjacent the end panel. The corner third panel includes a corner third panel cutout.

BRIEF DESCRIPTION OF THE DRAWINGS

The preferred and alternative embodiments of the present invention are described in detail below with reference to the following drawings.

DETAILED DESCRIPTION OF THE INVENTION

The present invention will now be described with reference to the accompanying drawings. The present invention is directed to a stackable container and container blank formed from a single piece of foldable material. By way of overview and with reference to FIGS. 1–6, one suitable embodiment of the present invention includes a single piece blank 20 of foldable material cut and scored to form a container 50. Specific details of the blank 20 and container 50 are described with more particularity below.

The blank 20 is cut scored, perforated or otherwise formed to include a plurality of panels which, when assembled, create the container 50 of the present invention. Wherever possible the same number is used in related panels of the blank 20 and container 50. More specifically, in all FIGURES, like numbers indicate like parts. Additionally, cuts are shown are solid lines, score lines as dashed lines and lines of perforation as broken lines.

For the purposes of this description herein, the downward direction is defined as the direction perpendicular to the outer surface of the bottom panel 22 when the container 50 has been erected. The upward direction is defined as the direction perpendicular to the inner surface of the bottom panel 22 when the container 50 has been erected.

The blank 20 and container 50, as shown in FIGS. 1–6 are made from any suitable material used in shipping. By way of non-limiting example, the present invention may be constructed from containerboard, paperboard, fiberboard, corrugated containerboard, plastics or combinations thereof. Specifically, the blank 20 and container 50 are constructed from a corrugated containerboard material that includes a single wall, double wall or triple wall material. However, as discussed, any other foldable material may be used to create the present invention.

Figure 1:
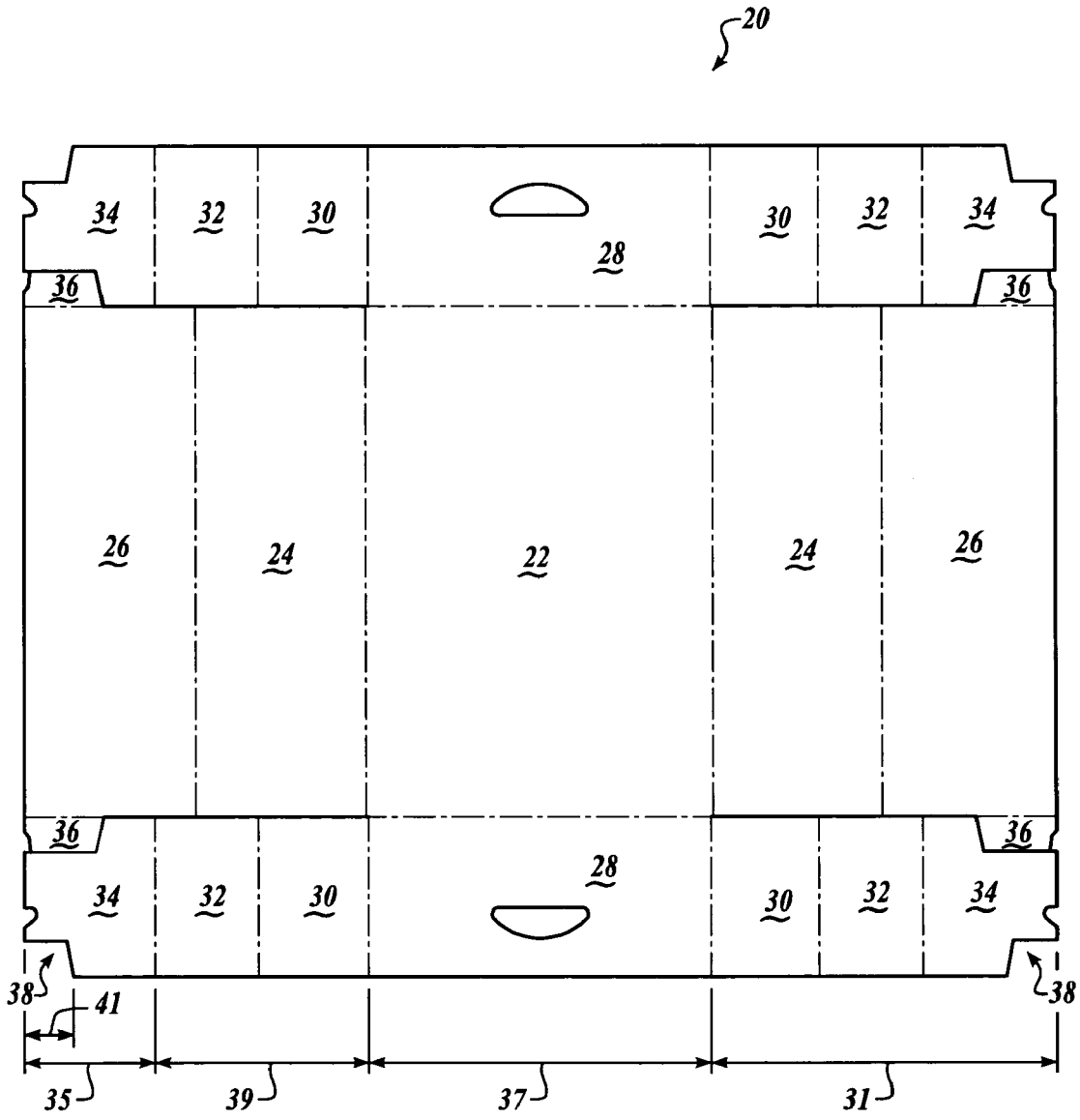
FIG. 1 is a plan view of a single piece container blank formed according to the present invention.
Figure 2:
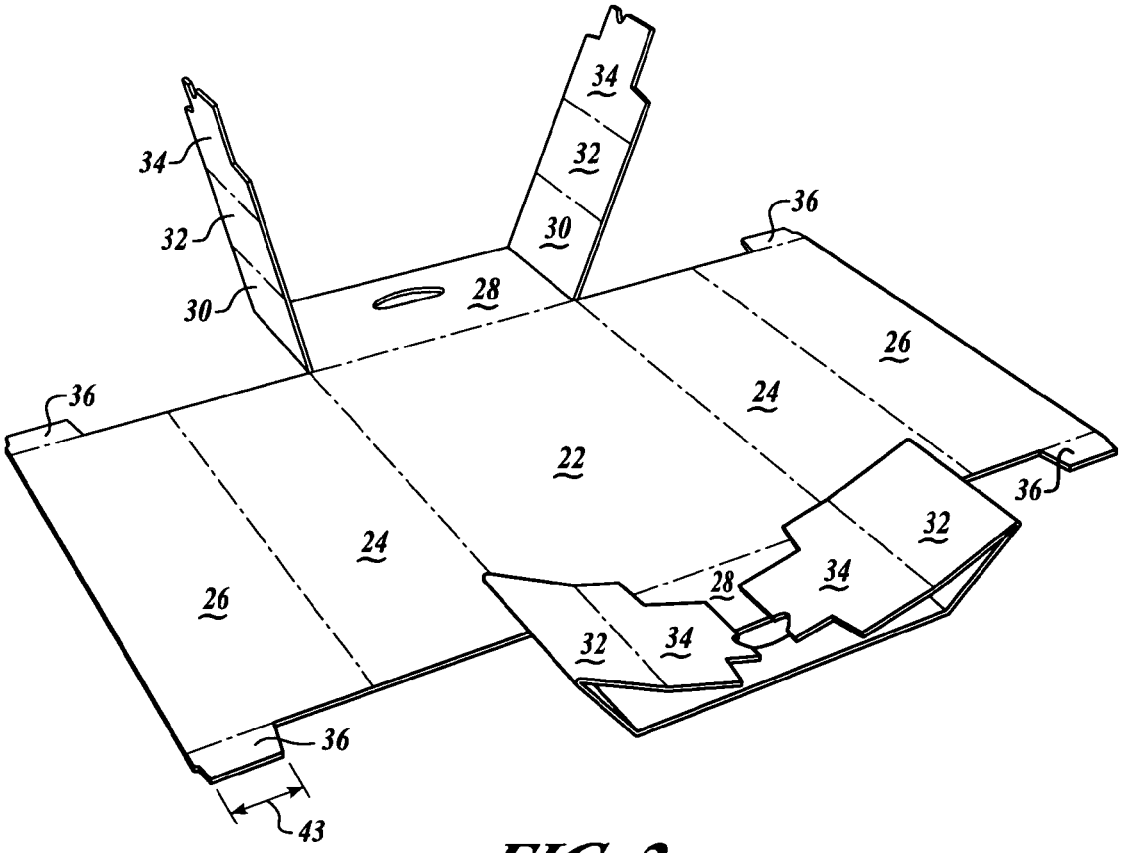
FIG. 2 is a perspective view of the container being formed according to the present invention.
Figure 3:
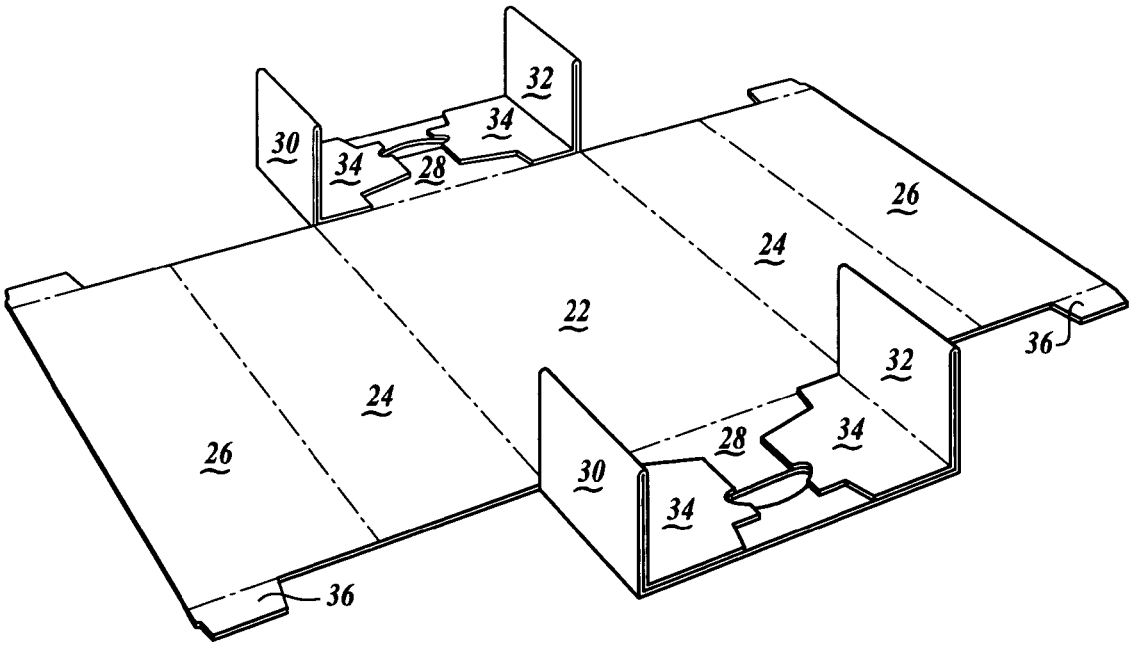
FIG. 3 is a perspective view of a partially assembled container formed in accordance with the present invention.

Referring now to FIG. 1, the blank 20 includes a bottom panel 22. A side panel 24 is connected with the bottom panel 22. An end panel 28 is connected with the bottom panel 22. A side panel 24 is connected with the bottom panel 22. A top panel 26 is connected with the side panel opposite the bottom panel 22. Connected with the top panel 26 is a top panel flap 36.

Connected with the end panel 28 is a corner reinforcement assembly 31. The corner reinforcement assembly includes a corner inner panel 30 connected with the end panel 28. A corner middle panel 32 is connected with the corner inner panel 30, opposite the end panel 28. A corner end panel 34 is connected with the corner middle panel 32, opposite the corner inner panel 30.

The relative lengths of the various panels are variable. However, in a presently preferred embodiment, the length 35 of the corner end panel 34 is less than one-half of the length 37 of the end panel 28. Also, it has been experimentally determined that a hinge length 39 to corner end panel length 35 ratio is preferably about 1–1.5, meaning the end panel length 35 is preferably half again as long as the hinge length 39 when the container 50 is formed.

The corner end panel 34 also includes a corner end panel cutout 38. The corner end panel cutout 38 is preferable sized relative to the top panel flap 36. Specifically, the length 41 of the corner end panel cutout 38 is at least about one half the length 43 of the top panel flap 36.

FIGS. 3–6 depict the formation of container 50 from the blank 20. Initially, the corner reinforcing assembly 31 is formed. The corner middle panel 32 is folded inwardly to bring the corner middle panel 32 adjacent the corner inner panel 30. As a result, the corner end panel 34 adjacent a portion of the end panel 28. Those skilled in the art will appreciate that the corner middle panel 32 and the corner inner panel 30 may be fastened together via any common fastening means, such as without limitation, adhesive, glues, staple or other mechanical fasteners, or combination thereof. Also, the corner end panel 34 may likewise be fastened to the end panel 28.

Figure 4:
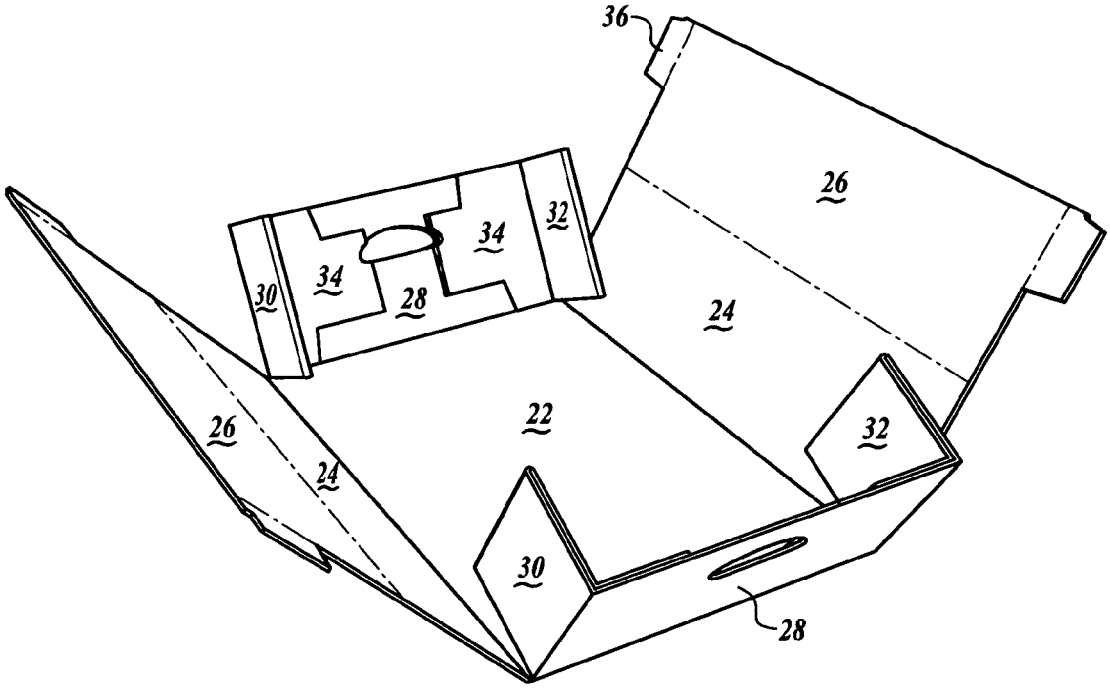
FIG. 4 is a perspective view of a partially assembled container made in accordance with the present invention.
Figure 5:
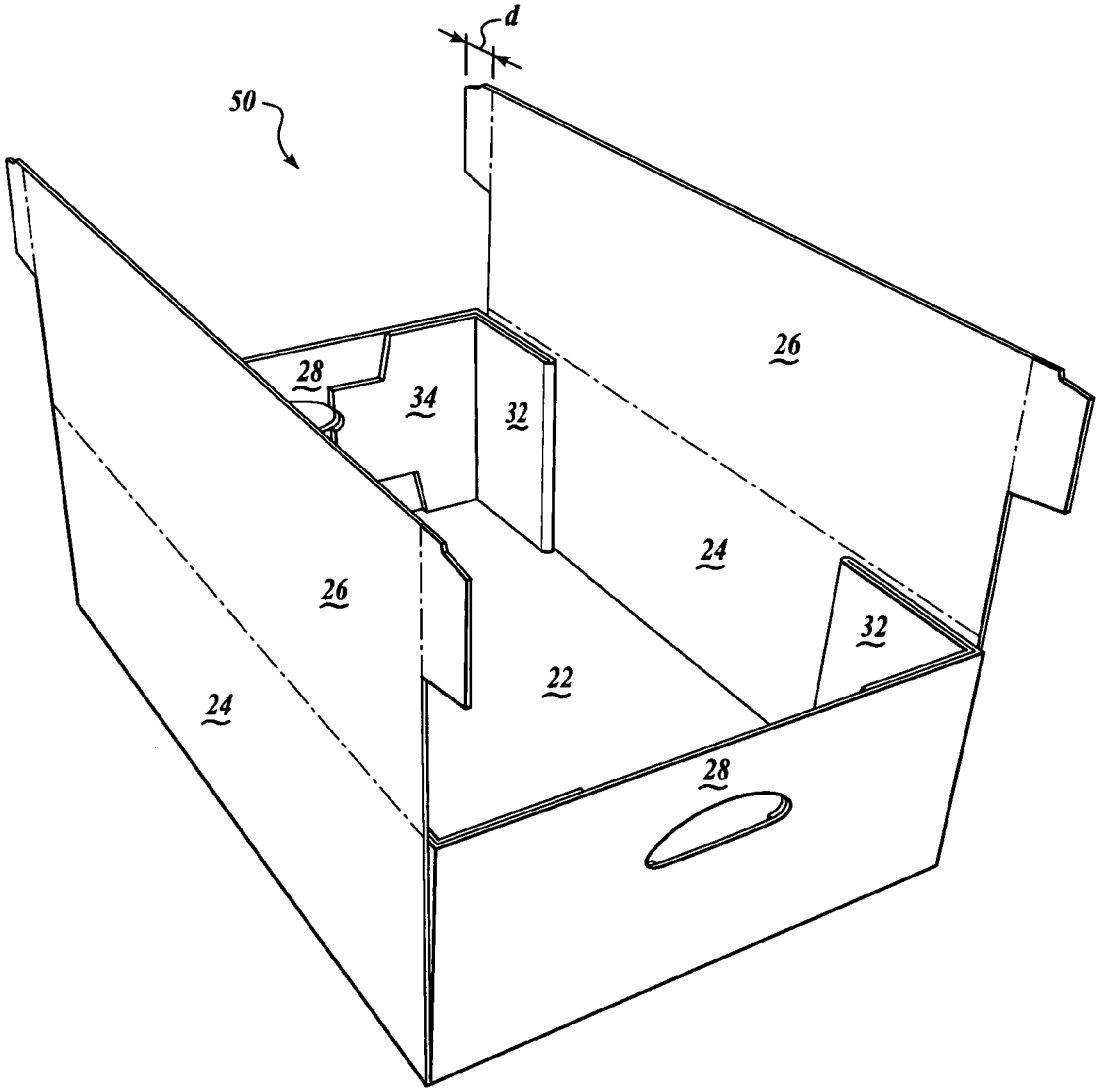
FIG. 5 is a perspective view of a partially assembled container.

As best seen in FIGS. 4 and 5, the end panel 28, with the formed corner reinforcing assembly 31, may then be folded upwardly relative to the bottom panel 22. The side panels 24 may then be folded upwardly such that side panels 24 about the corner inner panel 30 of the corner reinforcing assembly 31. The side panels 24 may then be fastened to the corner reinforcing assembly 31 via any means discussed above, or alternatively, the side panels may not be fastened to the corner reinforcing assembly 31.

Figure 6:
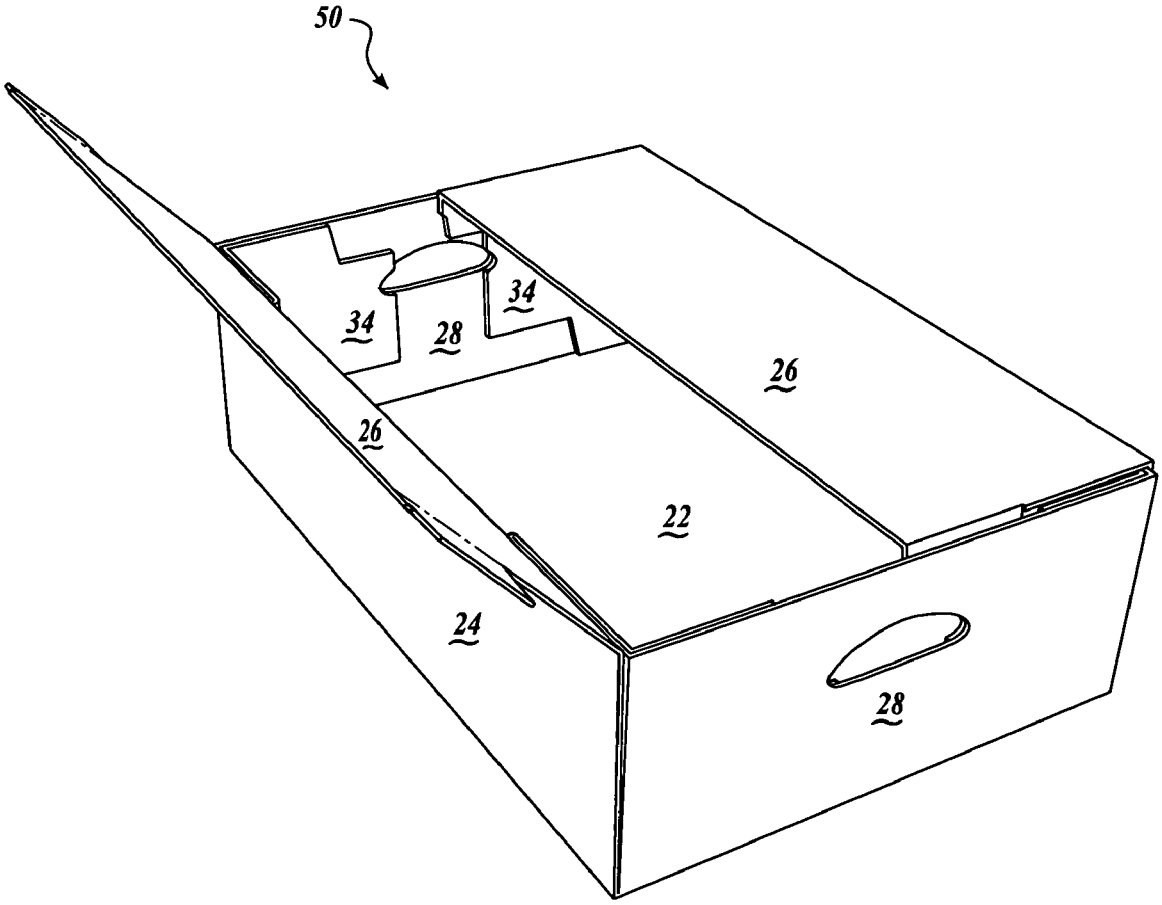
FIG. 6 is a perspective view of a container according to the present invention.

FIGS. 5 and 6 depict the formed container 50. Those skilled in the art will appreciate the top panel flaps 36 may be folded inwardly and the top panels 26 likewise folded inwardly to close the container 50. In the close state, the top panel flaps 36 rest upon a top edge of the corner end panel cutout 38 (FIG. 6). In this manner, the corner reinforcing assembly 31 helps support the top panels 26, thereby increasing the container's crushing strength.

When a corrugated containerboard is used as the material choice for the blank 20 and container 50 of the present invention, a novel aspect of the invention is introduced. Specifically, the blank is initially arranged to have the corrugated flutes running along the major axis of the container. Specifically, the flutes would run in a direction from one end panel 28 to the other end panel 28. As a result, when the container 50 is formed, the corner reinforcing assembly 31, like the end panels 28 and side panels 24, have the corrugated fluted lying vertically. Consequently, the container 50 is formed in its strongest possible configuration.

Any variety of additional elements may be included, such as, without limitation, vent holes, specialized liners or moisture barriers, etc., without departing from the spirit and scope of the present invention. Similarly, rounding or otherwise trimming the various panels is considered within the scope of the instant invention.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A single sheet of foldable material cut and scored to define a container blank, comprising:

a bottom panel a side panel connected with the bottom panel;

an end panel connected with the bottom panel;

a top panel connected with said side panel opposite said bottom panel;

a top panel flap connected with said top panel a corner first panel connected with said end panel;

a corner second panel connected with said corner first panel opposite said end panel;

a corner third panel connected with said corner second panel opposite said corner first panel, said corner third panel defining a corner third panel cutout, wherein said corner third panel cut-out extends to a free end of the corner third panel such that said corner third panel cut-out is cut from an edge of the corner third panel that lies substantially parallel to a line formed by the connection of the corner third panel to the corner second panel, said corner third panel cut-out also being cut from an edge of the corner third panel, opposite said top panel, that lies substantially perpendicular to a line formed by the connection of the corner third panel to the corner second panel, said container blank adapted to form a container wherein said corner third panel cutout forms a top edge that is below a top edge of the end panel in the region of the corner third panel cut-out.

2. The blank of claim 1, wherein the sheet of foldable material is at least one of a containerboard, paperboard or corrugated material.

3. The blank of claim 1, further comprising a handhold cutout in said end panel.

4. A single sheet of foldable material cut and scored to define a container, comprising:

a bottom panel;

an end panel connected with the bottom panel;

a side panel connected with the bottom panel;

a top panel connected with said side panel opposite said bottom panel;

a top panel flap connected with said top panel a corner first panel connected with said end panel, said corner first panel being adjacent said side panel;

a corner second panel connected with said corner first panel, said corner second panel being adjacent said corner first panel, opposite said side panel; and, a corner third panel connected with said corner second panel, said corner third panel defining a corner third panel cutout, wherein said corner third panel cut-out forms a top edge that is below a top edge of the end panel in the region of the corner third panel cut-out such that said corner third panel cut-out is cut from an edge of the corner third panel that lies substantially parallel to a line formed by the connection of the corner third panel to the corner second panel, said corner third panel cut-out also being cut from an edge of the corner third panel, adjacent the top panel, that lies substantially perpendicular to a line formed by the connection of the corner third panel to the corner second panel.

5. The container of claim 4, wherein the sheet of foldable material is at least one of a containerboard, paperboard or corrugated material.

6. The container of claim 4, further comprising a handhold cutout in said end panel.

7. The container of claim 4, wherein the length of said corner third panel is less than one half of the width of the end panel.

* * * * *